US005111762A

United States Patent [19]

Frangiamore

[11] Patent Number: 5,111,762

[45] Date of Patent: May 12, 1992

[54] METHOD AND APPARATUS FOR CLEANING MARINE EQUIPMENT INCLUDING BOATS, ENGINES AND TRAILERS THEREFOR

[76] Inventor: George P. Frangiamore, 502 Quail Crossing, Grand Prairie, Tex. 75051

[21] Appl. No.: 542,924

[22] Filed: Jun. 22, 1990

[51] Int. Cl.[5] ..... B63B 59/00

[52] U.S. Cl. ..... 114/222

[58] Field of Search ..... 114/222; 440/88, 113, 440/900; 134/167 R

[56] References Cited

U.S. PATENT DOCUMENTS

| | | | |
|---|---|---|---|
| 3,766,879 | 10/1973 | Jones | 114/222 |
| 4,030,440 | 6/1977 | Wickersham | 114/222 |
| 4,153,000 | 5/1979 | Henderson | 114/222 |
| 4,869,695 | 9/1989 | Sajdak | 114/222 |

*Primary Examiner*—Sherman Basinger
*Assistant Examiner*—Stephen P. Avila

[57] ABSTRACT

An apparatus for rinsing the interior of a marine engine that is attached to a boat immediately after the boat has been removed from a body of water. The apparatus is adapted to be affixed to the frame of a boat trailer in order to be carried by the boat trailer. A first reservoir holds as much fresh water as seems necessary for the cleaning job to be faced. An air tank holds compressed air and is placed in communication with the water reservoir at selected times in order to create a portable source of pressurized water. Appropriate hoses, wands, adaptors, cups, nozzles, etc., are provided for directing pressurized water that is released from the water reservoir so that the water may accomplish a flushing/rinsing job on a boat and engine and any accessories immediately after they have been removed from a lake, etc., while the engine is still hot and before any salty or foul water evaporates inside the engine. Both the water reservoir and the air tank are preferably made from pressurizable tanks of the kind commonly employed for holding liquefied petroleum gas, e.g., 40 pound butane bottles. Filling both the water reservoir and the air tank is conveniently done at a service station for automobiles or trucks, so that the boat owner does not face the expense of purchasing an air compressor or maintaining the same, etc.

26 Claims, 2 Drawing Sheets

METHOD AND APPARATUS FOR CLEANING MARINE EQUIPMENT INCLUDING BOATS, ENGINES AND TRAILERS THEREFOR

BACKGROUND OF THE INVENTION

This invention relates generally to the cleaning of marine equipment and especially boats and engines therefor, as well as the trailers that are frequently used to transport them; more specifically, it relates to an apparatus that is adapted to be mounted on a boat trailer in order that a boat and/or any engine that is used to propel the boat may be rinsed with fresh water immediately after use.

It is well known that the waters in which boats are sometimes used are not pristine; and even so-called fresh water lakes and rivers are sometimes so muddy and laden with silt that they constitute a real problem to those owners who value cleanliness in their boats and associated equipment. Those persons who use pleasure boats in salt water have even more cause to be worried about the nature of the water in which they place their boats. But with a boat whose exterior surface is being contaminated, at least the owner can see the buildup of salt and silt deposits that are left behind when a boat is removed from a body of water. What is not visible, because it occurs inside a water-cooled engine (motor), can be even more damaging than what occurs on the exterior of a boat.

Recognizing the long-term, hazardous nature of water that is laden with salt or silt, the manufacturers of relatively expensive engines (such as MerCruiser and Mercury marine engines) admonish owners of such engines to flush them with fresh water after each use. Regrettably, the written admonition to "flush after every use" is the kind of advice that is very good in theory but usually very difficult to practice. This is true because there are many more boats that are launched and retrieved at public boat ramps than are put into the water at private marinas having elaborate facilities and cleaning equipment. And very few public boat ramps make fresh water available to boaters, so that they may perform a cleaning operation on their engines before water begins to evaporate from the hot metal surfaces inside the engines. This evaporation of less than pure water starts the buildup of scale and deposits that can eventually clog cooling passages and cause engine failure.

Of course, some boaters think they are being suitably conscientious when they climb into their cars and pull their loaded boat trailers to the nearest town. Such boaters stop at the first self-service car wash facility that is available, wash off their equipment and assume that they've done the most that can be expected of them. Unfortunately, the damage that has already been done in the first 15 or 20 minutes after a hot engine has been removed from the water cannot be cured by simply flushing a cold engine with clean water at some facility having a faucet. It is an object of this invention, therfore, to provide an apparatus that will enable boat owners to accomplish—for the first time—what manufacturers have been suggesting for years, namely, flushing with fresh water after each use. But more particularly, it is an object of this invention to modify and make more rigid a preventative maintenance procedure by adding to the traditional manufacturer's suggestion a *time* qualification. Specifically, it is believed that engine manufacturers should have been saying in the past, and may now begin saying (without seeming foolish), "Flush with fresh water *immediately* after each use—and before the engine cools." With this invention, such a modified admonition can be heeded, and the longevity of both boats and their engines can be extended significantly.

It probably should be mentioned, however, that the adverse effects of sea water or other impure water has not been totally ignored by those who have turned their attention to boat and engine maintenance. In U.S. Pat. No. 3,886,889 to Burger entitled "Portable Cleaning Device for Outboard Motors" there is a disclosure of a shroud-like sack into which the drive portion of an outboard motor can be placed, if the motor is small enough so that it can be tilted upward to receive the sack when the engine is to be rinsed. The nature of the Burger device renders it unsuitable for large outboard motors, however, and there is doubt that it could be safely used on any inboard drive engines. Additionally, there is no explanation by Burger concerning where a person is to obtain the many gallons of fresh water that he shows in his sack, nor is there a statement of how long it would take to transport fresh water from some source on dry land out to a boat that is still resting in the water. Too, there is no explanation of how a boat owner can ensure that he will not run the risk of falling out of the boat when he is leaning over the stern for a substantial distance in an attempt to slip a Burger sack over the motor's raised prop. It follows, therefore, that a device like that shown by Burger does not seem to reveal a dependable solution to the problem of how to quickly rinse the inside of a water-cooled marine engine, regardless of the size of the engine or whether it can be safely reached from inside in the boat. It is an object of this invention to solve such a problem.

Still another object is to increase the satisfaction that boat owners have with respect to owning and using their boats, by reducing the buildup of visible scum or salt that causes a noticeable degradation in the ornamental appearance of what is usually a very attractive product.

One more object is to improve the process of rinsing a boat and its marine engine by providing cleaning water at a pressure that can be appreciably higher than the pressure that is typical of many municipal water sources.

These and other objects will be apparent from a reading of the following description and the claims that follow it, together with appropriate reference to the several figures of the drawing that are provided herewith.

DESCRIPTION OF THE FIGURES OF THE DRAWING

FIG. 6 is a schematic drawing of certain options that are available to a user of the system disclosed herein, including the possibility of multiple outlets for the simultaneous discharge of pressurized water through more than one outlet, and each outlet terminating in a different nozzle or the like.

BRIEF DESCRIPTION OF THE INVENTION

Figure 1:
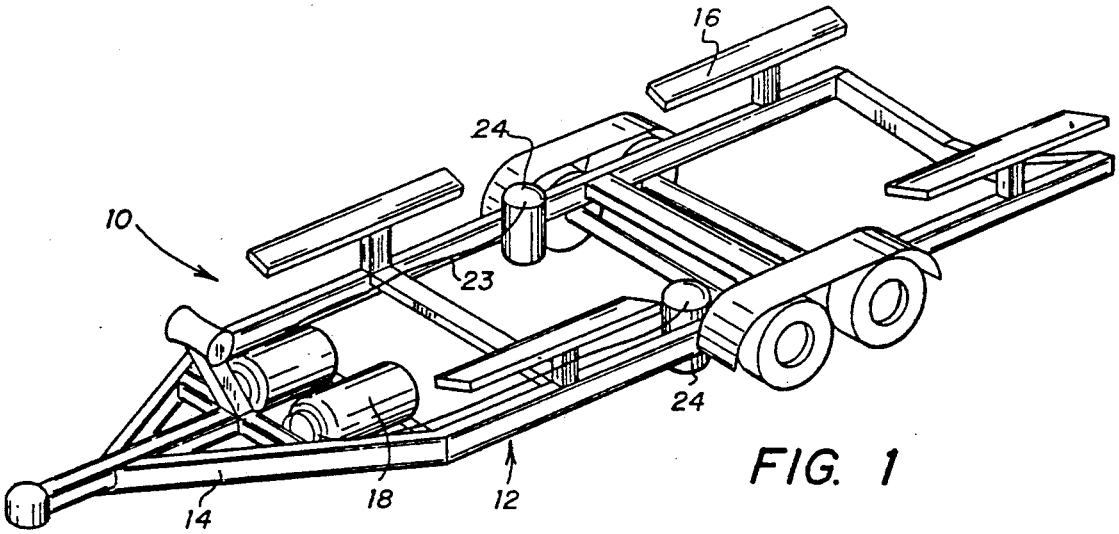
FIG. 1 is a perspective view of an exemplary boat trailer showing a apparatus of the invention mounted thereon, with air tanks mounted on the front of the trailer (where their weight will add relatively little to the tongue weight of the trailer), and water tanks mounted near the axles of the trailer.

In brief, this invention relates to an apparatus that is adapted to be affixed to the frame of a boat trailer in order to be carried by the boat trailer so that it will be available for use at any location where the boat trailer can be moved. The apparatus includes three principal elements: 1) a first reservoir for holding as much fresh water as seems to be desirable for the kind of cleaning job that is likely to be faced;2) a second reservoir for holding compressed air, said second reservoir being placed in communication with the water reservoir at selected times in order to create a portable source of pressurized water; and 3) appropriate hoses, wands, adaptors, cups, nozzles, etc., for directing pressurized water so that it may accomplish a washing/flushing/-rinsing job on a boat and engine immediately after they have been removed from a lake, river or bay, etc.

A convenient reservoir for receiving both water and compressed air is a pressurizable tank of the kind commonly employed for holding a liquefied bottle gas, e.g., butane, and having a size of 20 to 40 pounds (of bottled gas). Such tanks are readily available at stores that sell equipment to owners of recreational vehicles, as well as stores that furnish equipment for portable heaters, stoves and torches. Of course, typical butane tanks cannot be utilized in an apparatus as disclosed herein in the same condition in which they come "off the shelf." They must first be modified by providing them with suitable fittings and valves, so that they may receive and discharge their respective fluids at appropriate times. The hoses, wands, cups, nozzles and other devices that are used to discharge fresh water in the appropriate places may be of conventional construction and materials, because it is possible that the pressures contemplated for routine use of the invention may not exceed about 30 psi. By restricting maximum pressures in the air lines to about 200 psi or less, and limiting discharge pressure in the water lines to about 30 psi, a boat owner can readily charge his "take it with you" cleaning system with fresh water and compressed air at most any vehicle service station. And by waiting until just before arriving at a boat ramp to fill the water reservoir with tap water, a boat owner is not likely to notice any extra weight in pulling his trailer down the highway from home or a boat storage yard—weight that might be caused by, say, 10 to 30 gallons of fresh water. The weight of compressed air is negligible, of course, so an air tank for this invention may be charged at a remote location and transported essentially any distance over roads or highways without significantly affecting the towing weight of a boat rig.

By virtue of this invention, fresh water for cleaning and rinsing that often has been available only at places that are quite remote from a boat ramp will be present and immediately available for use by the boat owner—just as soon as a boat and its engine are removed from a lake or other body of water. Elapsed time can also be conserved with this invention, because one person can be flushing the inside of an engine and/or washing off the exterior of the boat at the same time that a companion is doing routine chores such as gathering fishing gear, cleaning fish, or making sure that nothing is inadvertently left behind at the boat ramp.

DETAILED DESCRIPTION OF A PREFERRED EMBODIMENT OF THE INVENTION

Figure 2:
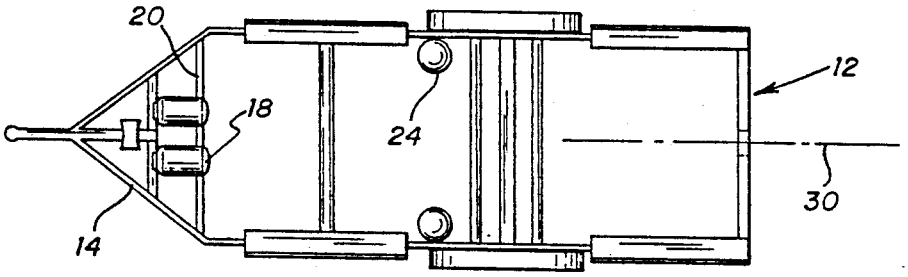
FIG. 2 is a top plan view of the boat trailer and cleaning apparatus shown in FIG. 1.
Figure 3:
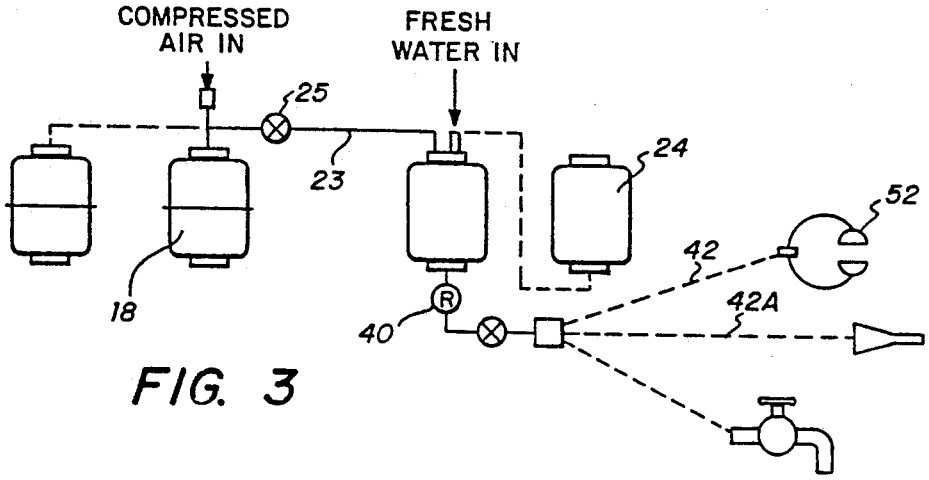
FIG. 3 is a diagrammatic view of the cleaning apparatus of the invention, and indicating the potential for enlargement of the cleaning system by hanging additional tanks on the trailer frame.

Referring initially to FIGS. 1 and 2, an apparatus 10 is mounted on an exemplary boat trailer 12 having a frame 14 and a superstructure 16 that is configured for supporting a boat on the frame. The boat trailer 12 need not necessarily be of any particular size or shape, because the apparatus 10 is deliberately designed to be modular in concept. Hence, the various parts of the apparatus 10 can be arranged and affixed to the frame 14 at whatever spots seem to be most logical to the boat owner. Only two factors usually need be given significant attention when deciding where to put various parts of the apparatus. First, there is a natural desire to keep the trailer reasonably balanced; so whatever significant weight is added to the trailer is ideally placed close to the centerline of the trailer and at places (such as near an axle) where adequate support is obtained without adding appreciably to the tongue weight of the trailer. Second, there is a desire to foster convenient access to the reservoirs that form part of the invention, so that they can be readily filled before a boat is ever brought near the water.

Figure 4:
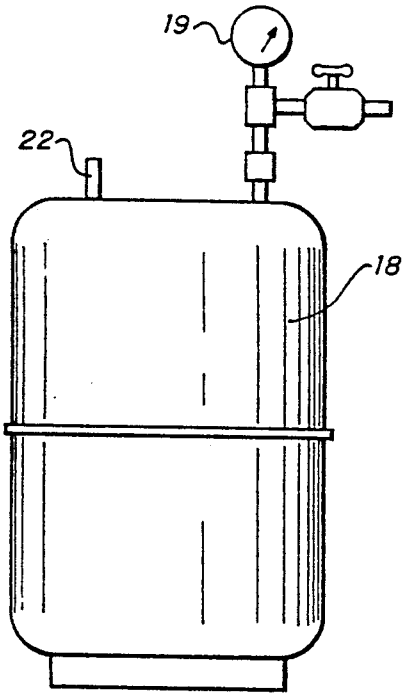
FIG. 4 is an elevational view of an air tank that is intended to hold compressed air under pressure, for the purpose of pressurizing one or more water tanks.

The apparatus 10 includes at least one reservoir or tank 18 for holding compressed air. The preferred embodiment of such a reservoir 18 is a steel tank of the kind that is routinely sold for storing liquefied petroleum gas, e.g., butane or propane, as shown in FIG. 4. Such tanks are usually manufactured to specifications that will allow them to be safely pressurized to at least 200 psi; in fact, they are usually certified for 240 psi, but a safety valve or plug will sometimes prevent them from reaching that pressure. Hence, they are quite safe for the pressures that will normally be employed with this invention, e.g., about 175 psi. By utilizing a portable butane tank having a nominal size of 20, 30 or 40 pounds (of propane), sufficient compressed air at 175 psi can be realized to do an adequate amount of cleaning in connection with essentially all of the boats/motors of the kind that will likely be removed from the water after use. Other tanks are commercially available which were originally designed to hold pressurized air; exemplary air tanks are sold by W.W. Grainger Inc. under the trademark "Dayton Speedaire." Some of them are built to specifications that qualify them for certification as meeting the ASME code for unfired pressure vessels as well as Department of Transportation regulations, and others are intended for use at such low pressures as to make such certification necessary. A boater may choose to have several low pressure tanks or fewer high pressure tanks, in order to achieve the desired quantity of air for his particular system.

Depending upon the maximum air pressure that a person decides to use, and depending upon the amount of pressurized cleaning water that the user wishes to have available, a second or even a third air tank 18 may be added to the system by simply mounting the tanks on the frame 14 at any convenient location and placing them in communication with one another. This is done by finding a clear place along the trailer frame for attaching one or more brackets 20 that can support a tray, frame or base upon which an air tank can rest. Using sturdy U-bolts and threaded nuts to mount a support bracket will permit the reservoirs to be easily removed from a first boat trailer and subsequently installed on a different trailer—if and when the first trailer is to be sold, scrapped, etc.

It is contemplated that two services that are routinely available at essentially all vehicle service stations will be exploited in the practice of this invention, one of those services being the furnishing of pressurized air for inflating vehicle tires. To this end, the air tanks 18 are provided with nipples or fittings 22 that are equivalent to the valve stems on automobile tires, so that a conventional air hose at a filling station may be used to charge an air tank 18. Of course, this charging is done in the same manner that an automobile tire is inflated, and with no more difficulty, provided that the air tank is mounted on the trailer in a place where it is readily accessible. To facilitate the periodic filling of one or more tanks 18, it is preferable that any air fittings 22 be on top of a tank 18 as the tank is installed on a trailer. Depending on whether a given air tank 18 is to be subsequently mounted vertically or horizontally on a trailer, the fitting will be initially positioned on the side or top of a conventional tank.

The air compressors in automobile service stations do not routinely provide air at more than 200 psi, and it is not expected that they will change anytime soon. So a boat owner wishing to practice the invention disclosed herein need have little fear of over-charging his system by putting too much air in a reservoir 18 at a local filling station. But to guard against the risk of over-pressurizing the air portion of the cleaning system, it is advantageous to provide a pressure gauge 19 on the air tank 18, preferably near the top where it can be readily seen by the person who is charging the air tank. The same nipple 22 that is used to charge an air tank 18 can also be used to vent air through an appropriate line 23 for the purpose of pressurizing the water reservoir (to be described). However, there should be at least one manually operable valve 25 between the air tank and the water reservoir, so that the water reservoir may be isolated from the air tank and charged at atmospheric pressure—even when the air tank has already been fully pressurized. The preferred air line 23 is a flexible hose which has so-called self-storing capabilities, in that it is coiled like a coil spring and will retract to the shortest possible length when released.

Perhaps it should also be pointed out that the air that is contained in one or more tanks 18 has not been in any way been contaminated or otherwise physically altered by placing it under pressure in the tanks 18. Therefore, the same mobile air tank 18 that is used to pressurize a water reservoir in accordance with this invention may also be used to inflate a flat tire on a boat trailer or automobile, or blow dirt from a clogged carburetor, or inflate an air mattress, etc. If the boat owner also owns an air-impact wrench, it may be possible to use the compressed air in tank 18 to remove the lug nuts on wheels that have been mounted at a service station. This can be significant because it seems that some service station attendants delight in playing a game called "Just how tight can I tighten this particular lug nut?" Those persons who have ever been alone at a remote spot with only an ordinary lug wrench and less strength that it takes to manually overcome the grip of air-tightened lug nuts will surely appreciate the advantage of being able to remove a wheel using compressed air instead of muscle. Therefore it is sometimes advantageous to use a conventional quick-connect fitting at the distal end of a flexible air hose 23, so that the hose can be disconnected from the water reservoir and easily connected to an air wrench or nozzle or the like.

It is perhaps worthy of mention here that a major benefit of the system being disclosed herein is that it does not require the use of an onboard compressor—on either the boat or the trailer or the vehicle that is pulling the trailer. Instead, the apparatus takes full advantage of the fact that automobile and truck service stations are plentifully scattered around the country, and those stations already have all of the equipment and supplies that are needed to practice this invention. That is, such stations routinely have plenty of fresh water and compressors for furnishing compressed air at a regulated pressure. While there may be a modest service charge for obtaining either pressurized air or water at some filling stations, many others furnish these two things at no charge, as a courtesy to customers who are buying expensive gasoline or Diesel fuel. By utilizing only passive reservoirs for storing compressed air and water, instead of providing the active pumps or compressors for creating compressed air, the boat owner avoids the expense and weight of a vehicle-mounted compressor and pump. Besides, it must be remembered that most boats that are being removed from a body of water are going to be towed on their trailers back to a city or a nearby boat-storage yard where at least more fresh water will be available. So if it seems that the cleaning and rinsing that can be accomplished with only one or two tanks of compressed air (and an appropriate quantity of water) is less than adequate for everything that is to be cleaned, at least the most sensitive part of the entire rig—the boat's engine—can be rinsed in order to be free of potentially harmful water and contaminants while the engine is still hot. Indeed, with this invention there is no reason why a water-cooled marine engine (also sometimes referred to simply as a boat motor) cannot be completely rinsed, both internally and externally, within a very few minutes after a boat is removed from a body of water.

After the engine has been thoroughly cleaned, the remaining pressurized water in the system 10 can be used to clean other equipment. In a descending order of priority, and based on the amount of likely damage that can be done by failure to remove salt water or the like, a boat owner may wish to rinse his engine, his boat, his trailer, his life preservers, any of his gear that has gotten wet, his clothing, etc. A fisherman may also want to thoroughly rinse his rods and reels, followed by the exterior and the interior of the boat, and then the trailer (where salt water from the boat may have dripped onto the frame), his tackle box and bait knife, etc. Depending upon the preference of a given boater, those things which are deemed to be the most expensive to repair or replace will likely be given initial attention.

Figure 5:
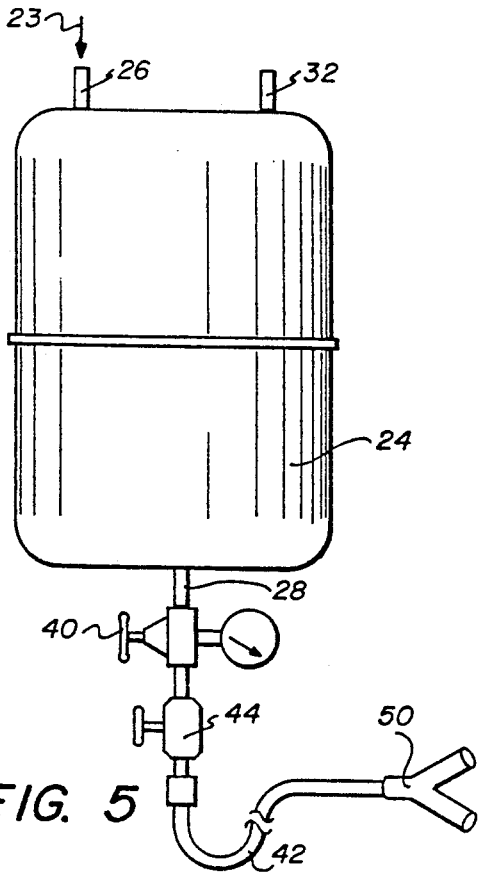
FIG. 5 is an elevational view of an exemplary water tank that is part of the water reservoir system.
Figure 6:
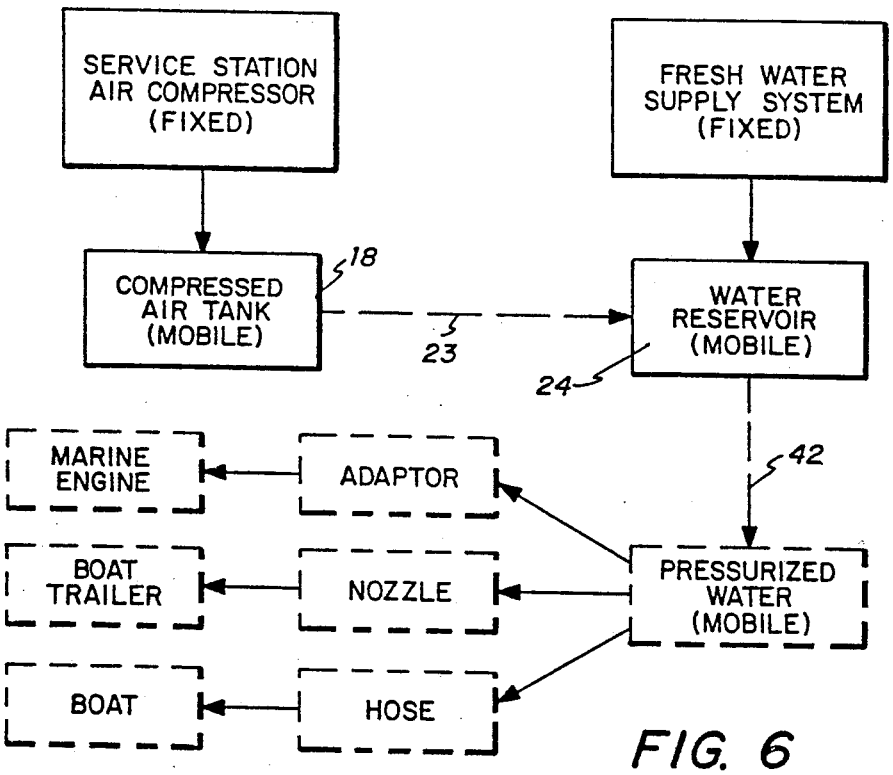

Turning next to FIG. 5, an exemplary water tank 24 is shown in the orientation that it would be expected to have when mounted on the boat trailer, with an air-supply nipple 26 at the top and a water hose fitting 28 at the bottom. Such an orientation will obviously facilitate draining the very last amount of water from a tank that forms part of the water reservoir system. It also facilitates filling a water tank completely, because water can be supplied at municipal water pressure at the bottom (through a water hose) until it flows out of an open nipple 26 at the top. The presence of water at the top of a bottom-filled tank offers assurance that all of the air has been forced out of the system and the tank is full of water.

A preferred water tank 24 is one that has a capacity of holding at least ten gallons of water, and the tank may also be of the type that is designed to normally hold liquefied petroleum gas. But if the clearance space that is available for mounting a single water tank on the trailer frame 14 is not adequate for mounting one large water tank, then it is advantageous to mount two smaller water tanks on the frame, and position them so that they are on opposite sides of a centerline 30 that passes longitudinally through the boat trailer. By placing an even number of water tanks on opposite sides of the centerline 30, the weight of the fresh water in a water reservoir can be evenly distributed on the trailer frame. Also, it is advantageous to place the water reservoir (comprising one or more water tanks 24) near the middle of the boat trailer 12, where the axles are located, so that road handling of the trailer will be essentially unaffected by the weight of any water in the reservoir. This is important because it is naturally desirable that the "feel" of the boat trailer when it is being pulled over a highway be unaffected by the presence or absence of water in the reservoir—if possible.

Optionally located at the top of the water tank 24 is a pipe nipple 32 which has threads that are compatible with the American National Standard thread form for garden hoses. By providing such a fitting at the top of the water tank 24, a common garden hose may be utilized to fill a water tank without removing the tank from the frame 14. On the other hand, such a pipe nipple 32 is inherently large enough to telescopically receive the relatively small discharge end of a water nozzle that is commonly found at automobile service stations. Hence, a water tank 24 with a top nipple can be filled by using either a conventional garden hose or a typical water nozzle at an automobile service station. A water tank with a bottom nipple can only be filled by connecting the tank through a hose to a pressurized water system.

Optionally mounted at the bottom of the water tank 24 and connected to fitting 28 is a pressure regulator 40 that is useful to restrict the pressure of rinse water that is discharged from a water hose 42. Also shown in FIG. 5 is a valve 44 for manually controlling the release of pressurized water from the tank 24. The regulator 40 is useful in order to render the system more nearly stable and consistent, so that water that is discharged through the hose 42 will be of a uniform pressure (e.g., 30 psi), regardless of the pressure within a water tank 24. An operating pressure of 30 psi has been found to be quite adequate for rinsing outboard and stern-driven marine engines and boats, etc., but the water discharge pressure can be adjusted to be 100 psi or more for cleaning the interior of a marine engine. Water at 100 psi is higher than the typical pressure that is available in many municipal water systems—which often operate at an average of about 30–60 psi. The regulator 40 also offers the opportunity to adjust the discharge pressure to fit a particular job which may have nothing to do with rinsing marine engines. For example, if a camp stove or an automobile engine catches fire, the regulator 40 may be quickly and easily adjusted to a suitable pressure for fighting a fire. And if the system disclosed herein is to be used as an aid in cleaning fish, then the regulator can be used to lower the discharge pressure to the point that cleaning is facilitated but the quality of the meat is not adversely affected.

Also shown in FIG. 5 is another advantageous component of an optimized water-supply system, namely, a bifurcated fitting 50 that has one inlet and two outlets, all of which are configured in accordance with the American National Standard thread form for garden hoses. By using a bifurcated fitting 50, two water hoses 42, 42A may be simultaneously connected to the water reservoir; on of the two water hoses may then be connected to a device 52 for directing rinse water to the interior of a marine engine. At the same time, a second water hose 42A can be terminated with a nozzle or wand—and used to rinse something else that is associated with the boat, such as the outside of the engine or the boat trailer or the boat itself, etc. Examples of specialized fittings that are designed for boat and/or engine use are found in the following U.S. patents: U.S. Pat. No. 2,611,631 to Benson, entitled "Flushing Device for Outboard Motors"; U.S. Pat. No. 3,347,202 to McCurry, entitled "Apparatus for Releasably Connecting a Boat Hull Fitting With a Source of Flushing Water"; U.S. Pat. No. 3,603,510 to Wagner, entitled "Protective Hull Washer"; U.S. Pat. No. 4,121,948 to Guhlin, entitled "Universal Flushing Apparatus"; U.S. Pat. No. 4,540,009 to Karls, entitled "Flushing Device for Outboard Motors"; and U.S. Pat. No. 4,729,393 to Ferguson entitled "Flushing Adaptor and Method of Manufacture". Wands of the type that are routinely found in self-service automobile washing facilities may also be readily connected to the distal end of a hose 42, for directing rinse water in a desired direction. To facilitate the use of a variety of devices at a location that may be remote from the trailer, a preferred length for a water hose (e.g., hose 42) is 50 feet. Also, it may be advantageous to invest in so-called quick-connect fittings, so that different devices may be switched at the distal end of a hose 42 with both convenience and speed.

Through proper use of the apparatus disclosed herein, it is possible to foster the longevity of marine equipment—especially engines, boats, and boat trailers—and anything else that is subject to deterioration or corrosive attack as a result of being used in salty or impure waters. By rinsing the equipment with clean water as soon as possible after the equipment has been used, and quickly removing any salty or fouled water—so as to deny it the opportunity to have an adverse impact on the equipment, a longer service life will almost surely be assured. Of course, this concept of rinsing immediately after use is likely to be most appreciated and to achieve its greatest success with regard to water-cooled marine engines, because now it will be possible to rinse them "in the field" instead of having to wait until the engines can be brought back to an urban area where fresh water is available.

To practice the invention, a reservoir of fresh and pressurized water is mounted on a boat trailer, so that the reservoir will be available wherever the trailer (and any boat and associated gear) can be moved. It is believed that the most expeditious and economical way of providing such a reservoir involves providing completely passive tanks that do not require any energy to operate. If a boat owner merely mounts suitable tanks on his trailer and then provides suitable hoses, valves, regulators, fittings, etc., he can rely on the investment in capital equipment that has already been made by service stations that cater to automobile and truck traffic. As a boat owner heads for a lake or the like, he can pull into one of those many service stations for the purpose of putting his air and water reservoirs in condition for subsequent use at a remote location.

First, the boat owner will likely want to charge his air tank(s) to the maximum available air pressure at a neighborhood service station. Many such filling stations have heavy duty compressors that have built-in pressure switches that come on at 145 psi and go off at 175 psi; so it is possible that a tank 18 can be charged to almost 175 psi within a few blocks of a boater's home. But if such a pressure is not enough to suit a boat owner, he may choose to visit a truck stop or some place that routinely uses air at slightly more than 175 psi. After filling the tank 18 with as much compressed air as possible, the boater is then ready to fill his water reservoir 24 with water. This can be done immediately after the air tank 18 is filled—or at a later time, after he has driven closer to the body of water where he expects to use his boat.

The next step in protecting marine equipment from unnecessary deterioration is to fill a water reservoir 24 with fresh water at atmospheric pressure. This can be done by connecting the reservoir 24 to a conventional faucet with an ordinary water hose 42; such a hose will ordinarily be stored in the boat or wrapped around some structure on the trailer 12. Turning the faucet handle to its ON position will force pressurized water at maybe 60 psi (usually from a municipal water system) into the reservoir 24, where it will be accumulated at atmospheric pressure. If the reservoir 24 has only a single water hose fitting at its bottom, any protective cap on the air line connector 22 (at the top of the reservoir) must be removed so that air may be expelled as water is forced in. Or, if the reservoir 24 also has a water nipple 32 on its top, the valve 44 at the bottom of the tank may be closed and water may simply be poured into the reservoir from the top. If the water reservoir 24 in a given system comprises more than one water tank, filling should commence with the lowest tank, in order that air will be driven upward and out of the tanks (and any connecting water lines) as water is accumulated.

Once the reservoir 24 is full of water at atmospheric pressure, the valve 25 is turned to its ON position, which will cause the compressed air in tank 18 to immediately pressurize the entire system. If a compressor for furnishing air at a suitable pressure is still readily available, the air tank 18 may then be "topped off." That is, the tank may again be charged with compressed air, in order to make up for any air that was drained from the tank and used to fill the air hose 23 and any air space above the water, etc. However, the use of an air line 23 with a small diameter (e.g., ¼ or ⅜ inch) will avoid the use of much air in pressurizing the system; so it would be possible to merely charge the air system once. Over 500 cubic feet of atmospheric air can be squeezed into two small propane tanks with no risk of nearing the bursting limit of the tanks. A customary shutoff valve at the top of the air tank 18 can then be used to isolate the air tank from the rest of the system, just in case there is a small leak in the air line 23 or a fitting is not fully tight, etc. Such a precaution will preclude the disappointment of arriving at a distant lake after a long drive and discovering that all of the pressurized air has leaked out of the system.

The entire charging operation takes relatively little time, and the boater is then ready to continue to the lake, river or canal where he plans to use his boat. If he should encounter someone along the road with tire trouble, having a portable air tank with air at 150 psi should make him a welcome sight to any stranded motorist. With minimal delay and little inconvenience, the boater can disconnect a flexible air line 23 at the water reservoir 24 and make it available for inflating a flat tire, etc. Then the air line can be reconnected to the water reservoir, and the system will once again be intact and ready for use in subsequently rinsing a marine engine or the like.

Upon arrival at a boat ramp, the boat is removed from the trailer and put in the water in the same way that it has always been launched, because the entire system 10 is mounted on the trailer in such a way as to be low and out of the way. So as far as trailer maneuverability and boat handling is concerned, the presence of the system disclosed herein is of no consequence.

After a day of fishing or water skiing or simply cruising has been completed, the boat is removed from the water in a customary manner and without any impact on the system 10. But after the boat has been raised to an elevated position on a trailer or a boat lift, and while the boat's engine is still hot, the opportunity for some real preventative maintenance arises. The water hose 42 is removed from its storage place and quickly connected to the discharge side of the water reservoir 24. The regulator 42 will normally be set for a relatively low pressure at first, e.g., 20 or 30 psi, and then the air valves will again be opened to place the water reservoir in communication with the pressurized air tank 18. Opening the water valve 44 will then cause pressurized water to flow from the reservoir 24 to any one of the selected devices that may be attached to the distal end of the hose 42. If one of the devices is of the type that directs water internally of a marine engine, the potentially corrosive salt water and/or fouled water within an engine can be thoroughly rinsed away, before the engine has a chance to cool to ambient temperature by virtue of water evaporation and convection. Of course, the pressure of the rinse water can be established by the regulator 40 to fit any personal preference or manufacturer's recommendations.

After the inside of the marine engine has been cleaned, any remaining pressurized water in the system will likely be used to rinse anything else that has become exposed to salty or fouled water. If experience has taught the boater that his particular system 10 has more than enough capacity to do all of the rinsing jobs that a person might want to do at a remote boat ramp or dock, he may wish to speed up the rinsing chore by avoiding sequential working. This can be done by using a bifurcated fitting 50 downstream of the water reservoir 24, so that two water hoses can be dispensing water from the system at the same time. After everything has been rinsed that reasonably should be, the valve 44 can be turned off and the water hose 42 returned to its storage place. Nothing else in the system 10 was removed from the trailer 12, so there is nothing else to store before the trailer is ready to be pulled back home or to a boat storage facility. If a boater stops for gasoline or some service at a filling station, he can recharge the air tank 18 and have even more cleaning water at an elevated pressure when he arrives home. This may be useful to remove any mud or other residue that might have been overlooked in the dark at the boat ramp.

While only the preferred embodiments of the invention have been disclosed herein in great detail, it should be apparent to those skilled in the art that the principles that have been revealed are capable of being applied in various ways. And no doubt certain modifications and variations of the invention will occur to those who practice the teachings herein. For example, it may be advantageous to build in permanent platforms on the trailer at the time that it is built, instead of adding auxiliary platforms or frames for supporting the various tanks that make up the air and water reservoirs. It may even be expedient to incorporate tubular tanks as an integral part of the trailer's conventional framework, so that the size of the external reservoirs 18, 24 can be reduced, etc. Because of the many variations in arrangement, size and location that are possible with this invention, it should be understood to be measured only by the scope of the attached claims.

What is claimed is:

1. An apparatus for fostering the proper care of boats and their accessories including water-cooled marine engines and the trailers that are routinely used to store and transport such boats and engines, said apparatus being particularly adapted for combination with a boat trailer having a frame and a superstructure that is configured for supporting a boat on the frame in an elevated position, comprising:

a) an air tank for holding compressed air;

b) a water reservoir for holding fresh water;

c) means for mounting the air tank and water reservoir on the frame of a boat trailer, such that the air tank and water reservoir will be present at the time and place when a boat is being removed from a body of water and placed on the boat trailer for transportation;

d) a water hose connected to the water reservoir, said hose being configured to serve as a conduit for the selective discharge of water from the reservoir;

e) a water valve associated with the water reservoir and the water hose for permitting the selective discharge of water through the water hose; and f) means for connecting the air tank to the water reservoir in such a way as to pressurize the water in the reservoir, whereby a stream of fresh water is forced out of the water reservoir when the water valve is opened, and whereby a pressurized stream of fresh water is available for rinsing a boat and accessories related to the boat immediately after the boat is removed from a body of water and placed on the boat trailer.

2. The apparatus as claimed in claim 1 wherein the air tank has a nipple having external threads and a normally closed valve of the type commonly found in automobile tires, whereby the air tank may be filled and pressurized at any automobile service station having compressed air for use in pressurizing customers' automobile tires.

3. The apparatus as claimed in claim 1 wherein the distal end of the water hose has a quick-change fitting, and further including at least two differently shaped connectors and nozzles, each of which has an inlet end that is configured to mate with the quick-change fitting, whereby an individual one of the differently shaped connectors and nozzles may be selectively attached to the distal end of the water hose for directing the flow of water in a desired direction.

4. The apparatus as claimed in claim 1 wherein the air tank has a capacity of about 10 gallons of liquid and a pressure rating of at least 200 psi, such that the air tank will hold several cubic feet of air at about 200 psi.

5. The apparatus as claimed in claim 1 wherein the water reservoir has a capacity of at least 15 gallons of water.

6. The apparatus as claimed in claim 1 wherein the means for connecting the air tank to the water reservoir constitutes an air line that is connected to the top of the air tank through a fitting to which the air line can be selectively connected and disconnected, and wherein the fitting which is used to receive compressed air for the air tank is the same fitting that is used to connect the air tank to the water reservoir.

7. The apparatus as claimed in claim 1 wherein the water hose has thread-type fittings at each of its two ends, and the fittings are compatible with the American National Standard thread form for garden hoses.

8. The apparatus as claimed in claim 1 wherein the water reservoir is divided into two distinct containers, and there being a conduit connecting the two containers, and wherein the means for mounting the water reservoir on a trailer frame constitutes a structure for mounting respective ones of the two containers on opposite sides of a centerline that runs longitudinally of a boat trailer, whereby the weight of the fresh water in a water reservoir can be evenly distributed on the trailer frame, and whereby road handling of the trailer will be essentially unaffected by the addition of the weight of water in the reservoir.

9. The apparatus as claimed in claim 1 wherein the means for mounting the air tank on a trailer is structurally configured in such a way that the air tank will be mounted near the front of the trailer and adjacent the bow of a boat that is mounted on a trailer superstructure, such that access to the air tank will be readily available to a person standing on the ground, whereby the air tank is easily rechargeable from a source of compressed air at essentially ground level.

10. The apparatus as claimed in claim 1 and further including a pressure restrictor that will limit the pressure of fresh water that is discharged from the water hose, regardless of the amount of pressure within a water reservoir, whereby the water reservoir may be pressurized to a substantially greater pressure than might be desirable for rinsing salt water or fouled water from a boat or its accessories.

11. The apparatus as claimed in claim 10 wherein the pressure restrictor is adjustable so as to limit the pressure of any discharged fresh water to a range of about 30 to 60 psi.

12. The apparatus as claimed in claim 1 wherein a bifurcated fitting is connected to the water reservoir in order that two water hoses may be simultaneously connected to the water reservoir, whereby one of the two water hoses may be connected to a device for directing fresh water to the interior of a marine engine at the same time that a second hose is being used to rinse something associated with the boat, including something selected from the class that includes the exterior of the marine engine, the interior and exterior of the boat, and the boat trailer.

13. An apparatus for facilitating the proper maintenance of boats, marine engines and trailers that are subjected to corrosion from salty or fouled water after they are used in such water—by providing a source of fresh cleaning water for rinsing such boats, engines and trailers immediately after they are removed from the salty or fouled water, comprising:

a) a boat trailer having a frame with a front, a rear and a centerline running longitudinally of the frame, and also having a superstructure upon which a boat may be mounted for storage or transportation;

b) an air tank mounted on the trailer frame, and further including a refilling device for permitting a boat owner to pressurize the air that is contained in the tank by connecting the air tank to a compressor;

c) a water reservoir mounted on the trailer frame, and further including a device for permitting a boat owner to fill the water reservoir with fresh, clean water at atmospheric pressure;

d) means for selectively placing the air tank in communication with the water reservoir, such that pressurized air may be used at will to force the discharge of water from the water reservoir;

e) a water discharge hose connected to the water reservoir for directing a stream of fresh water in a desired direction when water is discharged from the reservoir; and f) a valve for controlling the discharge of pressurized water from the reservoir when fresh water is needed to rinse salty or fouled water from a boat or engine after they have been removed from a body of salty or fouled water.

14. The apparatus as claimed in claim 13 wherein the water reservoir is sized to hold at least 15 gallons of fresh water, and the air tank is configured to hold compressed air at a pressure of at least 200 psi.

15. The apparatus as claimed in claim 13 wherein the water reservoir and the air tank are mounted on the boat trailer with threaded fasteners, whereby the water reservoir and the air tank are removable from the boat trailer and subsequently installed on a different boat trailer.

16. The apparatus as claimed in claim 13 and further including a manually operable valve placed in an air line between the air tank and the water reservoir, said valve being effective to selectively isolate the water reservoir from the air tank during the process of pressurizing the air tank alone.

17. The apparatus as claimed in claim 13 wherein both the air tank and the water reservoir are fabricated from pressure-rated containers of the type commonly used to store and selectively dispense liquefied petroleum gas such as butane and propane.

18. The apparatus as claimed in claim 13 wherein the air tank is located on the boat trailer near the front of said trailer, and wherein the water reservoir is located near an axle that supports the trailer with respect to the ground, and wherein the air tank and the water reservoir are in communication with one another through a flexible air line.

19. In connection with water-cooled marine engines for boats, said engines having interiors and exteriors, the method of fostering the longevity of engines that are used in salty or fouled water, comprising the steps of:

a) mounting on a boat trailer a reservoir of fresh and pressurized water, so that the reservoir will travel with the trailer and thereby be as portable as is the trailer;

b) locating said boat trailer at a boat-loading facility such as a boat ramp in order to receive a boat and its associated engine immediately after they have been used and are ready to be removed from salty or fouled water; and c) connecting the interior of the engine to the pressurized reservoir of fresh water immediately after removing the boat and its associated engine from a body of salty or fouled water, and allowing fresh water that is selectively discharged from the reservoir to rinse out the interior of the engine while the engine is still hot from having been used, whereby the engine may be rinsed immediately after it has been used and before any significant corrosion begins to affect the interior of the engine.

20. The method as claimed in claim 19 wherein the water reservoir is pressurized to a maximum of about 175 psi by connecting an air tank to the water reservoir, said air tank having been pressurized at a remote facility which provides compressed air at a maximum of about 175 psi.

21. The method as claimed in claim 19 wherein the water reservoir is provided with two discharge outlets, and including the step of connecting one of those outlets to a device for forcing fresh water through the interior of a marine engine, and connecting the second discharge outlet to a conventional garden hose having a nozzle at its distal end, whereby the nozzle may be manipulated to direct a stream of rinse water at the exterior of a engine at the same time that the engine is being internally rinsed by water that passes through the first discharge outlet.

22. The method as claimed in claim 19 wherein there is provided an isolation valve between an air tank carried by the trailer and a water reservoir carried by the trailer, and including the step of closing the isolation valve and substantially filling the water reservoir with water at atmospheric pressure before placing said reservoir into communication with the air tank carrying compressed air.

23. The method as claimed in claim 22 wherein the water reservoir is initially filled with about 20 gallons of fresh water and the air tank is initially filled with air at a pressure of about 150 psi at a location that is remote from the boat-loading facility.

24. The method as claimed in claim 19 wherein a regulator is provided on the discharge side of the water reservoir, and including the step of selectively regulating the pressure of discharged water to no more than about 30 psi.

25. The method as claimed in claim 19 wherein the pressure of discharged water is varied such that a first pressure is used when the water is being forced into the interior of a marine engine, and a second pressure is used when the water is being discharged directly into the atmosphere.

26. The method as claimed in claim 25 wherein the pressure of discharged water is regulated so as to be about 100 psi for rinsing the interior of a marine engine, and is regulated so as to be no more than 30 psi for rinsing the exterior of an engine.

* * * * *